US006595455B2

(12) United States Patent
Romes

(10) Patent No.: US 6,595,455 B2
(45) Date of Patent: Jul. 22, 2003

(54) ROLLED FABRIC DISPENSING APPARATUS AND FALL PROTECTION SYSTEM AND METHOD

(75) Inventor: Gary E. Romes, Cincinnati, OH (US)

(73) Assignee: Guardian Fiberglass, Inc., Albion, MI (US)

( * ) Notice: Subject to any disclaimer, the term of this patent is extended or adjusted under 35 U.S.C. 154(b) by 0 days.

(21) Appl. No.: 09/858,874

(22) Filed: May 17, 2001

(65) Prior Publication Data

US 2002/0050543 A1 May 2, 2002

Related U.S. Application Data

(60) Provisional application No. 60/243,276, filed on Oct. 26, 2000.

(51) Int. Cl.[7] ..... B65H 59/02; E04B 1/00

(52) U.S. Cl. ..... 242/422.5; 52/746.11; 52/749.12

(58) Field of Search ..... 242/422.5, 557; 52/746.11, 749.12, 63

(56) References Cited

U.S. PATENT DOCUMENTS

| | | | | |
|---|---|---|---|---|
| 1,587,842 | A | | 6/1926 | Knox |
| 2,041,910 | A | | 5/1936 | Ericson |
| 2,587,985 | A | | 4/1952 | Elmendorf |
| 2,861,525 | A | | 11/1958 | Curtis et al. |
| 3,121,649 | A | | 2/1964 | Oliver |
| 3,135,070 | A | | 6/1964 | Waring et al. |
| 3,307,306 | A | | 3/1967 | Oliver |
| 3,559,914 | A | | 2/1971 | Alderman |
| 3,619,437 | A | | 11/1971 | McDonald |
| 3,662,509 | A | | 5/1972 | Studzinski |
| 3,694,306 | A | | 9/1972 | Fricklas |
| 3,729,879 | A | | 5/1973 | Franklin |
| 3,735,538 | A | | 5/1973 | Ramins |
| 3,835,604 | A | | 9/1974 | Hoffman, Jr. |
| 3,845,602 | A | | 11/1974 | Alderman |
| 3,861,616 | A | | 1/1975 | Dubberke |
| 3,969,863 | A | | 7/1976 | Alderman |
| 4,014,150 | A | | 3/1977 | Wells et al. |
| 4,031,681 | A | | 6/1977 | Charniga |
| 4,047,345 | A | | 9/1977 | Alderman |
| 4,047,346 | A | | 9/1977 | Alderman |
| 4,050,972 | A | | 9/1977 | Cardinal, Jr. |
| 4,075,807 | A | | 2/1978 | Alderman |
| 4,147,003 | A | | 4/1979 | Alderman |
| 4,151,692 | A | | 5/1979 | Holcombe |
| 4,213,282 | A | | 7/1980 | Heckelsberg |
| 4,222,212 | A | | 9/1980 | Alderman |
| 4,233,791 | A | | 11/1980 | Kuhl et al. |
| 4,243,468 | A | * | 1/1981 | Boyd ..... 242/557 |
| 4,296,581 | A | | 10/1981 | Heckelsberg |
| 4,303,713 | A | | 12/1981 | Clemensen et al. |
| 4,329,823 | A | | 5/1982 | Simpson |
| 4,333,291 | A | | 6/1982 | Musgrave et al. |
| 4,333,292 | A | | 6/1982 | Musgrave |
| 4,361,993 | A | | 12/1982 | Simpson |
| 4,391,075 | A | | 7/1983 | Musgrave |

(List continued on next page.)

OTHER PUBLICATIONS

Owens–Corning Elaminator Sales and Instruction Training Video, 100 Series, 1994.
Owens–Corning Elaminator Insulation System, 1996.
Owens–Corning System Thinking Advertisement, 1998.
Dispense–R Insulation System by Thermal Design, 1998.
Perfect R, The Perfect Solution for Every Job, CGI Silvercote Inc.

*Primary Examiner*—William A. Rivera
(74) *Attorney, Agent, or Firm*—Hall, Priddy, Myers & Vande Sande

(57) ABSTRACT

Apparatus for dispensing a rolled fabric across the width of at least two longitudinal structural supports. In some embodiments, apparatus which is capable of forming a fall protection system which conforms to OSHA standards when constructing metal insulated roof systems.

20 Claims, 13 Drawing Sheets

U.S. PATENT DOCUMENTS

| | | | | | |
|---|---|---|---|---|---|
| 4,393,634 | A | | 7/1983 | McDermott et al. | |
| 4,446,664 | A | | 5/1984 | Harkins | |
| 4,446,665 | A | | 5/1984 | Berger | |
| 4,460,433 | A | * | 7/1984 | Boyd | 242/557 |
| 4,528,789 | A | | 7/1985 | Simpson | |
| 4,528,790 | A | | 7/1985 | Lo et al. | |
| 4,557,092 | A | | 12/1985 | Brueske | |
| 4,566,239 | A | | 1/1986 | Smigel et al. | |
| 4,602,468 | A | | 7/1986 | Simpson | |
| 4,635,423 | A | | 1/1987 | Ward | |
| 4,637,188 | A | | 1/1987 | Crothers | |
| 4,699,484 | A | | 10/1987 | Howell et al. | |
| 4,709,523 | A | | 12/1987 | Broderick et al. | |
| 4,711,407 | A | | 12/1987 | Boon | |
| 4,736,552 | A | | 4/1988 | Ward et al. | |
| 4,967,535 | A | | 11/1990 | Alderman | |
| 5,195,764 | A | | 3/1993 | Schantz et al. | |
| 5,491,952 | A | | 2/1996 | Alderman et al. | |
| 5,495,698 | A | | 3/1996 | Alderman et al. | |
| 5,551,203 | A | | 9/1996 | Alderman et al. | |
| 5,561,959 | A | | 10/1996 | Alderman et al. | |
| 5,653,081 | A | | 8/1997 | Wenrick et al. | |
| 5,653,083 | A | | 8/1997 | Alderman et al. | |
| 5,664,740 | A | | 9/1997 | Alderman et al. | |
| 5,685,123 | A | | 11/1997 | Alderman et al. | |
| 5,720,147 | A | | 2/1998 | Wenrick et al. | |
| 5,746,077 | A | | 5/1998 | Zaccagni | |
| 5,784,966 | A | | 7/1998 | Brown et al. | |
| 5,884,449 | A | * | 3/1999 | Alderman et al. | 52/746.11 |
| 5,921,057 | A | | 7/1999 | Alderman et al. | |
| 5,946,804 | A | * | 9/1999 | Alderman | 52/749.1 |
| 5,968,311 | A | * | 10/1999 | Zupon, Jr. et al. | 52/746.11 |
| 6,247,288 | B1 | * | 6/2001 | Harkins | 52/746.11 |
| 6,308,489 | B1 | * | 10/2001 | Romes | 52/746.11 |
| 6,363,684 | B1 | * | 4/2002 | Alderman et al. | 52/749.12 |

* cited by examiner

ROLLED FABRIC DISPENSING APPARATUS AND FALL PROTECTION SYSTEM AND METHOD

RELATED APPLICATIONS

This application is the non-provisional application of U.S. Provisional Application No. 60/243,276 filed Oct. 26, 2000, invented by Gary E. Romes, and upon which the present application relies for priority.

FIELD OF THE INVENTION

This invention relates to apparatus for dispensing a rolled fabric across the width of at least two longitudinal structural supports and, in particular embodiments, to apparatus capable of forming a fall protection system which conforms to OSHA standards when constructing metal insulated roof systems.

BACKGROUND OF THE INVENTION

Metal roof structures are typically comprised of a series of rafters which extend parallel to each other from each side of a building to its roof peak. Longitudinal structural supports (eg. purlins or bar joists) are typically mounted on top of and perpendicular to these rafters in a similarly parallel fashion.

In one manner of constructing such a known metal roof structure as described, a fabric (eg. polyethylene) is first rolled in sheets over these purlins. These sheets then serve as a vapor barrier for the metal roof structure. Once the insulation is installed over the sheet of fabric, the insulation is secured in place with hard (typically metal) roof sheeting attached to the upper surface or flange of the purlins.

Heretofore, it has been known in the art to install fabric across the top of purlins by hand or by various carriage devices such as illustrated in U.S. Pat. No. 5,495,698. Installation by hand is often quite time consuming and labor intensive and gives rise to certain safety problems particularly during unusual weather conditions such as high winds. Federal and state OSHA regulations have been passed to enhance safety in this regard through the mandated use of fall protection devices.

In particular, the purlins on which an insulation installer must work are typically located at a considerable height above ground level. Because an installer is working at such heights, there is substantial risk of both personal injury and death if an installer/laborer falls from the roof surface. Various fall protection devices have been designed specifically to prevent such injuries or deaths from occurring. One such prior art device is known commercially as Elaminator® and is employed by Owens Corning Fiberglass, Inc. and its various contractors to install metal, insulated roof systems. This fall protection system is believed to be disclosed in U.S. Pat. No. 6,195,958 and includes a cantilever type structure (e.g. a metal plate or frame type structure) which extends from the frame of a fabric dispensing device between the purlin spacings in a direction opposite that of the direction of the dispensing of fabric i.e. typically towards the worker/installer. Such a cantilever, in addition to supporting the roofing fabric sheet as it is being dispensed from a roll, also serves as a means to prevent a worker from falling through that particular space (between two adjacent purlins) within which a particular cantilever is extending. Such a cantilever achieves effective fall protection, but only at the location where the cantilever happens to be located (i.e. at the time of the fall). In addition, such a cantilever structure is rather large and cumbersome and adds considerably to the weight and cost of the roof fabric dispensing device.

Installation of fabric, in general, can also be expensive when it requires extensive pre-preparation (i.e. machine setup) because of the large size of certain known devices used to install the rolled fabric. Further, these known devices are often difficult to install, are designed to operate only in one direction along the length of a purlin, or must be detached and reattached through a cumbersome process when the tensioning device (which biases the roofing fabric roll against the purlin) reaches a purlin cross support. Further time and expense is added when additional, cumbersome equipment must then be added for fall protection.

In view of the above, it is apparent that there exists a need in the art for a rolled fabric dispensing apparatus which overcomes the above drawbacks and which, in certain embodiments, provides a fall protection system which conforms to OSHA standards and yet is easy to employ without additional time and expense. It is a purpose of this invention to fulfill this need in the art, as well as other needs which will become apparent to the skilled artisan once given the following disclosure.

SUMMARY OF INVENTION

Generally speaking, this invention fulfills the above-described needs in the art by providing: a rolled fabric dispensing device for applying a sheet of fabric from a roll of fabric across a surface of a building structure comprised of at least one pair of longitudinally extending substantially parallel structural members, the rolled fabric dispensing device comprising:

a frame member;

means for rotatably supporting a fabric roll;

means for biasing against a surface of a fabric roll thereby to selectively prevent rotation of a fabric roll when a roll is being supported by the means for rotatably supporting a fabric roll;

means for moveably supporting the rolled fabric dispensing device on a surface of a building structure; and means for preventing reverse travel of the rolled fabric dispensing device on the building structure.

In another embodiment there is provided: a rolled fabric dispensing device for applying a sheet of fabric from a roll of fabric across a surface of a building structure comprised of at least one pair of longitudinally extending substantially parallel structural members, the rolled fabric dispensing device being capable of securing a first end of the sheet of fabric such that when a second, opposite end of the sheet of fabric is secured by sufficient means, the sheet is capable of supporting a 400 lb weight dropped from a height of 42 inches, the rolled fabric dispensing device comprising:

a frame member;

means for rotatably supporting a fabric roll;

means for biasing against a surface of a fabric roll thereby to selectively prevent rotation of a fabric roll when a roll is being supported by the means for rotatably supporting a fabric roll;

means for moveably supporting the rolled fabric dispensing device on a surface of a building structure; and an anti-reverse brake:

wherein the antireverse brake and the means for biasing against a surface of a fabric roll, in combination, are capable of securing the first end of the sheet of fabric thereby to form a layer of fabric which, when secured at the second, opposite end, is capable of supporting a 400 pound weight dropped from a height of 42 inches.

In a further embodiment there is provided: a rolled fabric dispensing device for applying a sheet of fabric from a roll of fabric across a surface of a building structure comprised of at least one pair of longitudinally extending substantially parallel structural members, the rolled fabric dispensing device comprising:

a frame member;

a plurality of cylindrical rollers for rotatably supporting a fabric roll;

a brake plate for biasing against a surface of a fabric roll thereby to selectively prevent rotation of a fabric roll when a roll is being supported by the cylindrical rollers;

rollers for moveably supporting the rolled fabric dispensing device on a surface of a building structure; and an anti-reverse brake for preventing reverse travel of the rolled fabric dispensing device on the building structure.

IN THE DRAWINGS

FIG. 1 is a side plan view illustrating a known rolled fabric dispenser in the prior art as disclosed as prior art in U.S. Pat. No. 6,393,797.

FIG. 1A is a three-dimensional view of a prior art rolled fabric dispenser as disclosed in U.S. Pat. No. 6,308,489.

DETAILED DESCRIPTION OF CERTAIN EMBODIMENTS

Figure 1:
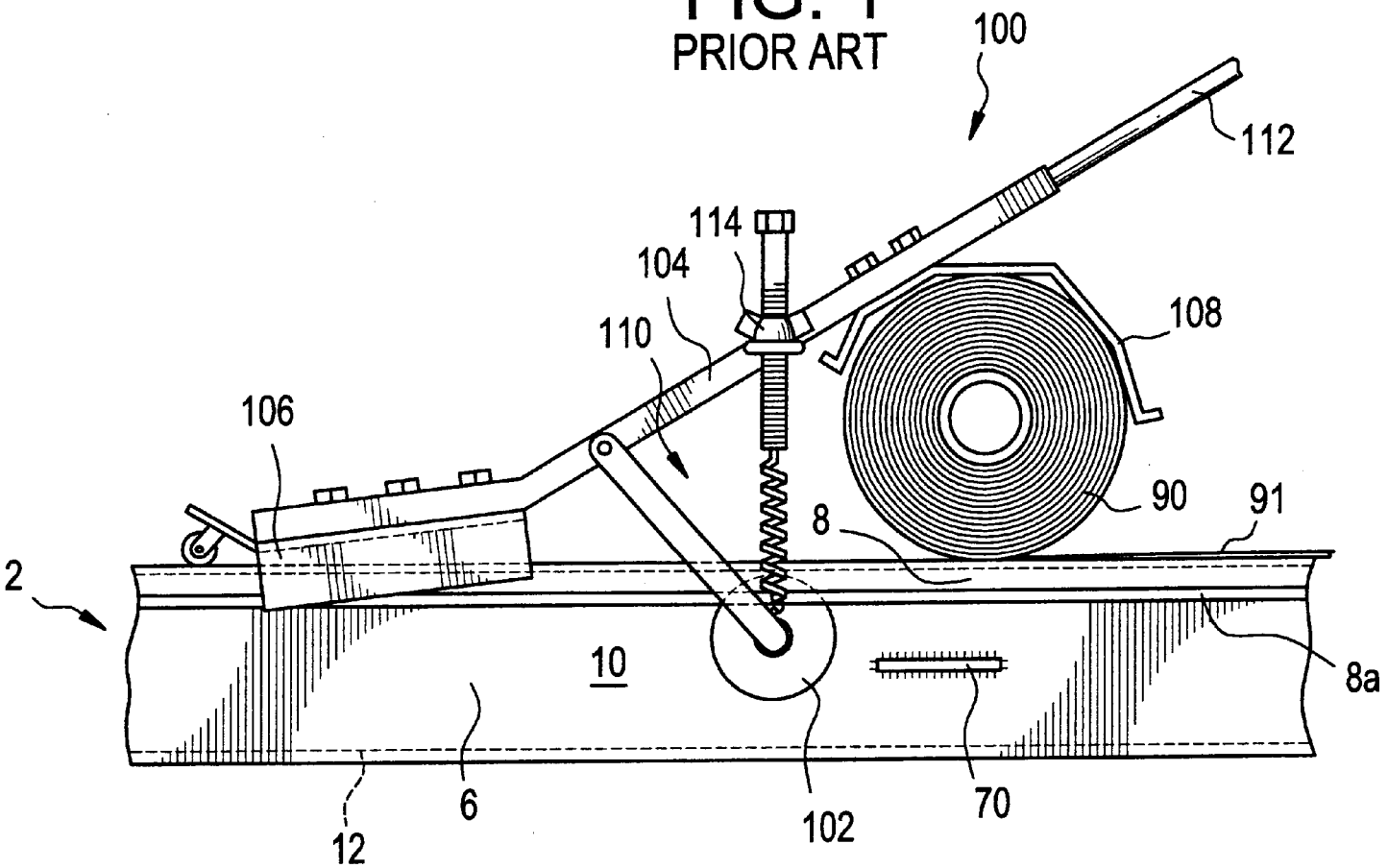
FIG. 1 PRIOR ART
Figure 1A:
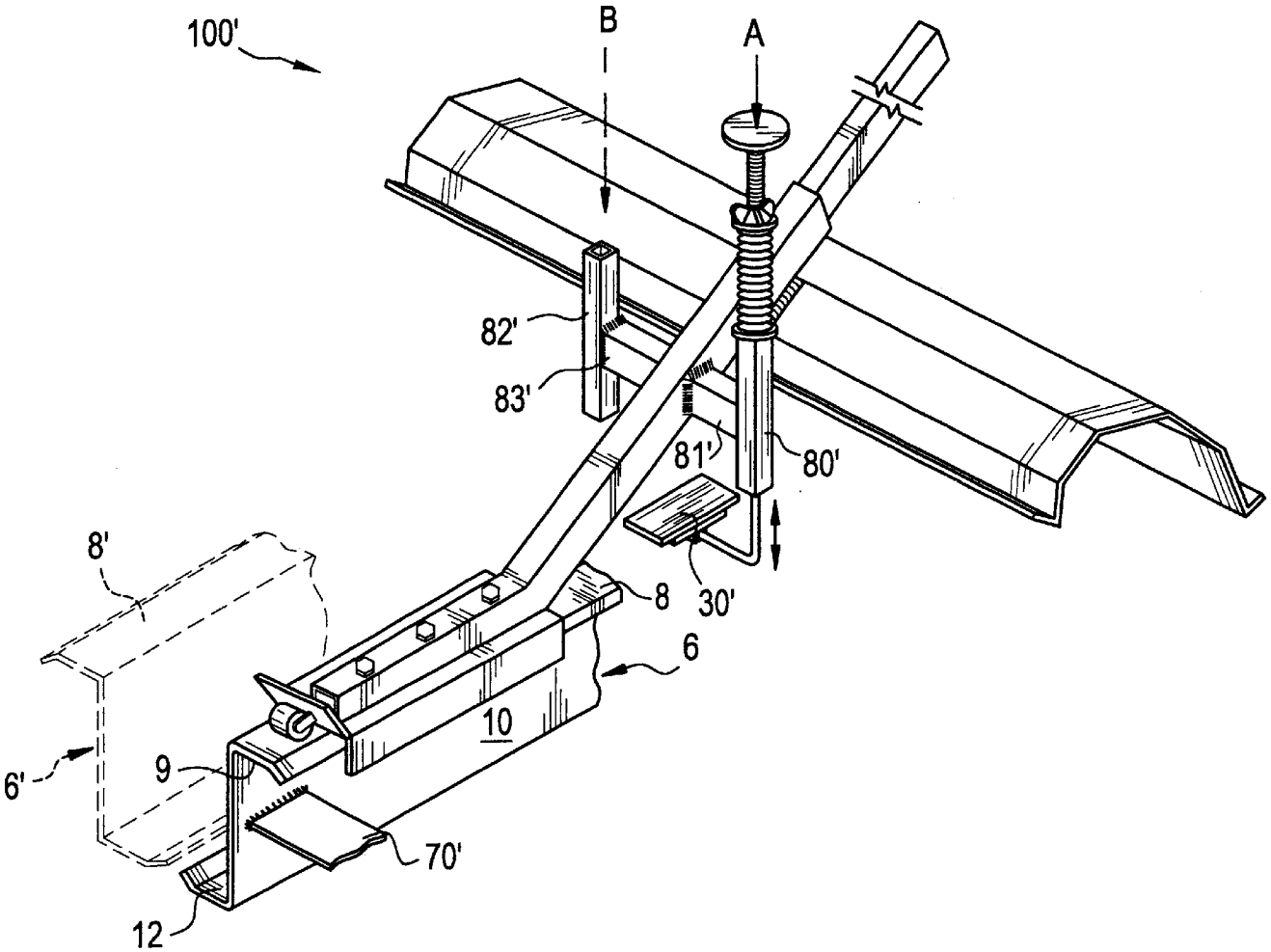
FIG. 1A PRIOR ART
Figure 2:
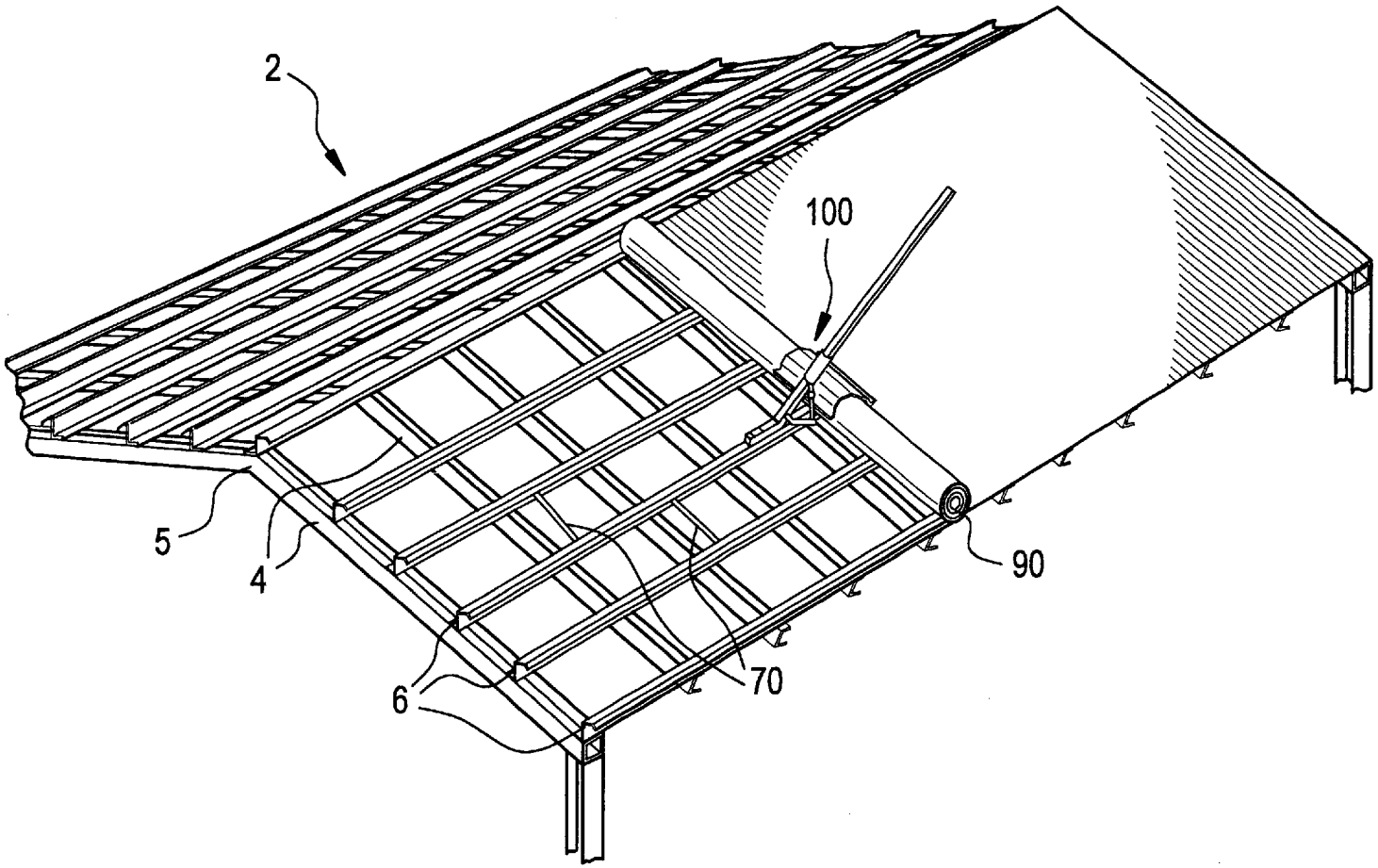
FIG. 2 PRIOR ART
FIG. 2 is a three-dimensional view of the prior art dispenser illustrated in FIG. 1 shown on a typical roof structure.

FIGS. 1, 1A and 2 (prior art) illustrate two known and rather successfully used, commercial dispensers 100 and 100' for applying a roll of fabric 90, such as high-density, woven-polyethylene, over purlins in a roof system. Generally speaking, commercial dispenser 100 includes frame member 104, guide 106 for embracing the top flange of a purlin (or girt) 6 with a minimum amount of friction, and fabric roll retaining means 108 for retaining a roll of fabric 90 against the surface of the flanges of purlins 6. Provided as a means for biasing the roll against the purlin flanges onto which the sheet 91 of fabric is applied (with or without adhesive or adhesive tape first being applied) is tensioning device 110. Through its biasing spring, adjustable by wing nut 114, the entire device 100 is secured to the upper surface of the purlin flange via a glide roller 102, upwardly biased by the coil spring against the undersurface of the flange. For convenience, only purlin 6 and cross support member 70 are shown in FIG. 1.

FIG. 1A is an improved commercialized embodiment of the dispenser in FIG. 1 currently in successful use. Its two principal improvements are its ability to be easily adapted to either a right or a left extending purlin flange via its "H" shaped construction at 80', 82', 83' and its low profile plate 30' which allows for continuous dispensing despite the presence of purlin cross-members 70'.

As illustrated in FIG. 2, the typical roof structure 2 experienced in practice, normally includes a plurality of parallel purlins 6, as well as cross support members 70. As shown in FIG. 1, purlins 6 are conventionally "Z" shaped in cross section and include a vertical web portion 10, which connects a top flange 8 to a lower flange 12 each of which extends perpendicularly from web portion 10. Purlins 6 may be installed in the roof structure so as to have their top flanges 8 (for example) oriented in the same or opposite directions. Other purlin types are known however and are contemplated to be within the field of use of the present invention.

When prior art dispenser 100 is employed, and the dispenser is mounted in place on a purlin 6 to dispense fabric 90, such as is illustrated in FIG. 1, tensioning device 110 biases glide wheel 102 against the under surface of top horizontal flange 8. In turn, this biasing force serves to hold guide 106 and a roll of fabric 90 (via engagement means 108) firmly against the upper surface of top horizontal flange 8. In order to dispense the roll of fabric into a sheet 91 extending across the purlins by residing on top of the flanges 8, push pole 112, shown inserted in frame 104, may be used to propel the dispenser 100 along the length of purlin 6, thereby unrolling fabric 90 onto the upper surface of the roof structure 2 (top flange 8). A similar function is employed by dispenser 100', as can be seen in FIG. 1A, whose low profile glide mechanism 30' avoids most cross members 70' which interfere with continuous operation of dispenser 100'.

Referring again to FIG. 2 there is illustrated a typical metal roof structure, generally indicated at 2. This figure helps demonstrate the problems with dispenser 100 (or 100') when faced with such a popular roof structure and further serves to highlight the improvements of the invention herein.

Generally speaking, roof structure 2, as illustrated, includes rafters 4 which are fixed in a parallel arrangement and extend from one side of the roofing structure 2 to the roof peak as indicated at 5. In practice, rafters 4 may be spaced as shown or, at other times, more widely spaced. Typically such spacing is approximately 25 feet centerline to centerline with respect to these rafters 4. Purlins 6 (or in other embodiments, bar joists) are fixedly attached via their lower horizontal flange 12 to, and on top of, rafters 4 in a perpendicular configuration. They are normally spaced at a distance of five feet (centerline to centerline) in a substantially parallel fashion. At times, of course, other spacing is employed. In addition, the top horizontal flanges 8 of the purlins 6 do not always extend in the same direction. In some cases, for example, purlins 6 may be installed with the top horizontal flanges 8 extending both towards and away from the roof peak 5 (e.g. both right and left in relation to the forward direction the dispenser takes when dispensing the fabric, see FIG. 1A at 6' and 8'). Cross support members (i.e. bracing members) 70 (or 70') are provided and are attached to adjacent vertical web portions 10 of purlins 6 (spanning the distance between two parallel purlins) to provide additional strength to the roofing structure 2.

The use of cross support members 70 presents the problem referred to above, which is associated with dispenser 100 and which is overcome by dispenser 200 of this invention and dispenser 100' of FIG. 1A. As shown best in FIG. 1, wheel 102 of prior art dispenser 100 comes into interfering, obstructing, contact with cross support member 70 during the dispensing process. This necessitates the disengagement of dispenser 100 each time a cross support member 70 is reached. The magnitude of this problem is heightened by the generally time consuming and cumbersome fashion of the disengagement process. As can be seen, each time the dispenser 100 is to be mounted or removed to or from a purlin, wing nut 114 must be adjusted (i.e. threaded upwardly) a sufficient distance to allow the large glide wheel 102 to be removed from under flange 8, including its lip 8*a,* and then readjusted after clearing the cross member, to the proper tension, each time a cross member obstructs the path of the dispenser. Moreover, as another problem, each time a purlin flange extends in a different direction, the device must be started in a different direction or another device having the glide member on the other side of frame member 104 put into service.

As can be seen in FIG. 1A, both of these problems are overcome by my prior art device through the use of a low profile mechanism 30' and an "H" shaped tubular configuration at 80', 81', 82' and 83' which allows the changing of plate member 30', and its accompanying spring construction, from side A to side B as desired.

Both of these problems are, also again, solved by the subject invention through the use of a unique dispenser structure which will be described in greater detail in the paragraphs that follow. Generally speaking however, and with particular reference to FIGS. 3–10, a unique dispenser 200 is provided which is capable of dispensing along the full length of a purlin 6 without the need for removal upon encountering a cross support member 70 and which is also capable of dispensing in any direction along the length of a purlin irrespective of the orientation of the purlin top flange 8. In addition, dispenser 200 is capable of locking itself in a desired position on a roof surface and of preventing undesired unrolling of fabric from rolls 90.

Referring still to FIGS. 3–10, dispenser 200 generally includes a frame 203 and associated elements capable of retaining a roll of fabric 90 as well as enabling dispenser 200 to travel smoothly and unencumbered along the length of roof purlins or other analogous building elements regardless of the presence of cross members 70 in the roof structure. Still further, certain other elements are provided which are capable of locking dispenser 200 to a purlin at a desired location thereon.

Figure 3:
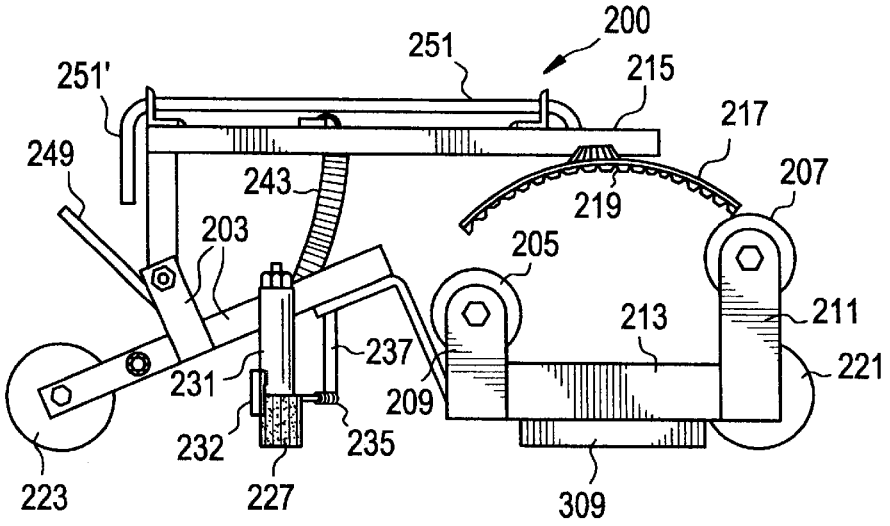
FIG. 3 is a side plan view of a rolled fabric dispenser according to one embodiment of this invention.

More specifically, and with particular reference to FIG. 3, frame 203 has attached thereto a sub-frame 213 which includes two sets of arms 209 and 211, each set being provided for supporting a single rotatable metal cylinder (i.e. cylindrical rollers 205 and 207). In particular, dispenser 200 carries rolls of fabric (i.e. fabric roll 90 not shown in FIG. 3 for convenience) upon these cylinders where they are relatively free to rotate during the fabric dispensing operation. In the embodiment as illustrated, arm set 211 extends to a height greater than that of arms 209. This serves to elevate roller 207 above the height of roller 205 and thus aids in retaining fabric roll 90 within the dispenser (because it is difficult to pull a fabric roll 90 over the additional height of roller 207).

To secure roll 90 within dispenser 200 (see FIG. 5), and further to selectively secure roll 90 against unwanted rotation (and thus against undesired unrolling of fabric), biasing brake plate 217 is provided. Brake plate 217 is preferably of a generally arcuate shape and is pivotally attached to frame 203 via pivotable arm 215. In order to bias brake plate 217 against a roll of fabric (via arm 215) being carried, tension spring 243 is provided and is attached to arm 215 at one end and to a location proximal frame 203 at its other end. Arm 215 is pivotable, of course, so that brake plate 217 is capable of maintaining continuous contact with roll of fabric 90 even as the fabric roll becomes smaller as fabric is dispensed. In addition, this pivoting feature permits relatively easy loading and unloading of fabric rolls as will be described below.

As aforesaid, brake plate 217 is biased against fabric roll 90 (FIG. 5) via tension spring 243 which, in the illustrated embodiment, is attached at one end to frame 203 and at its opposite end to arm 215. Also optionally provided is a serrated plate 219 attached to the undersurface of brake plate 217. In particular, plate 219 is provided to increase the amount of friction between the surfaces of the fabric roll 90 and the brake plate 217 thereby to maximize the ability of brake plate 217 to control the rotation of a fabric roll.

Although plate 219 may be composed of any known material or combination of materials, examples of such plates may be formed from molded rubber, plastic, textured cloth, or any other material suitable for supplying friction. Specifically, this added friction (as between a fabric roll 90 and brake plate 217) helps prevent fabric roll 90 from unrolling when not desired (e.g. such as might otherwise occur if high winds were present at a jobsite).

Figure 6:
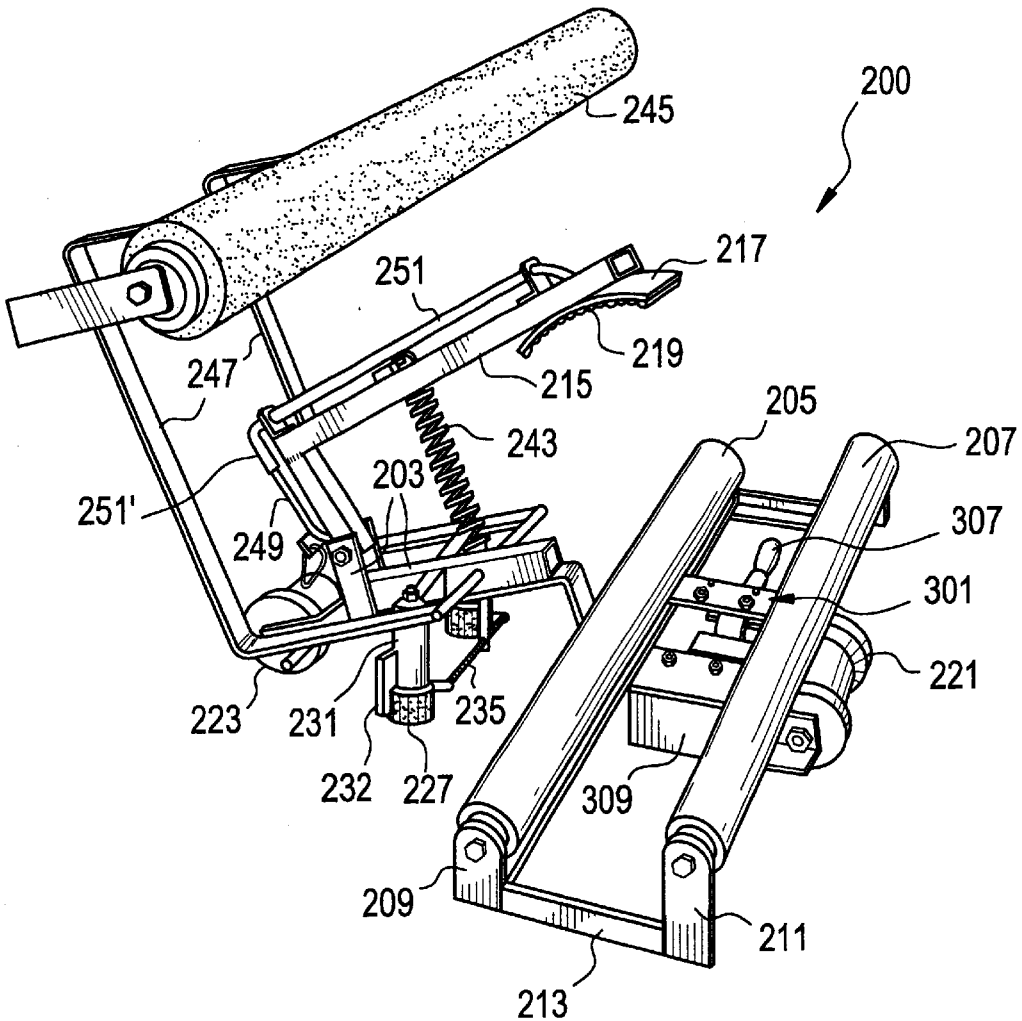
FIG. 6 is a three-dimensional view of the embodiment illustrated in FIG. 5.
Figure 6A:
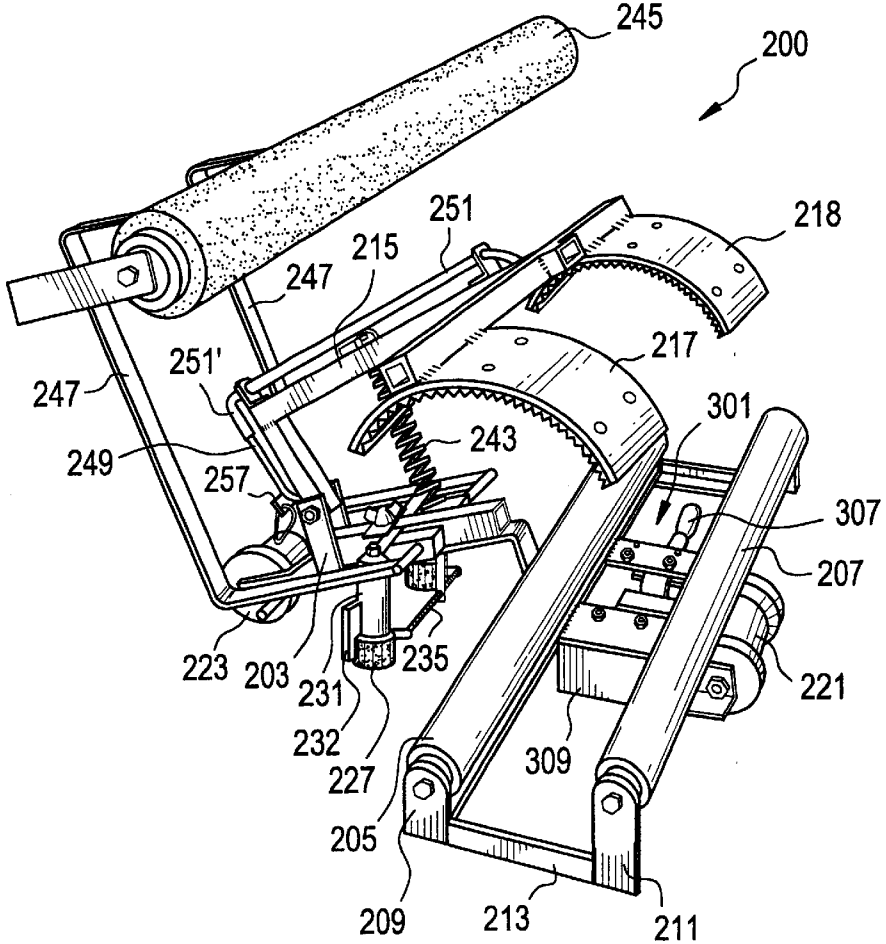
FIG. 6A is a three-dimensional view of an alternative embodiment of the rolled fabric dispenser illustrated in FIG. 6.

In certain exemplary embodiments, one such embodiment being illustrated in FIG. 6A, two brake plates i.e. brake plates 217 and 218 are provided in order to hold (i.e. bias against) fabric roll 90 in a more secure fashion. Such an embodiment provides more contact surface area between the brake plates (217 and 218) and roll 90 and thus, of course, imparts more friction to the surface of roll 90 for greater holding power.

Figure 5:
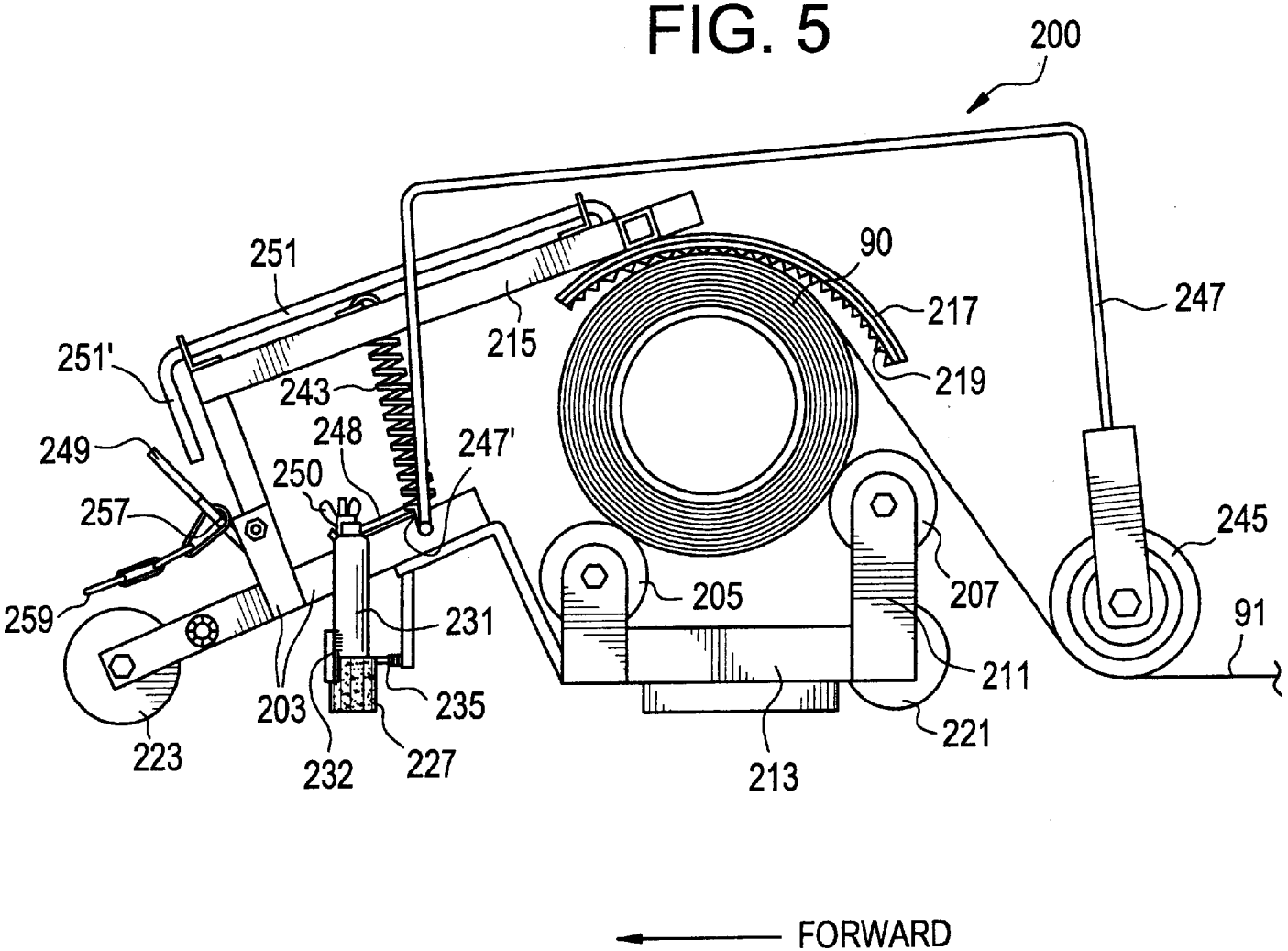
FIG. 5 is a side plan view of another embodiment of the rolled fabric dispenser according to this invention.

In certain further embodiments, rollers 205 and 207 are mounted in particularly desirous locations so that they are spaced a distance from each other which is less than that of the distance of the outside diameter of the typically cardboard core of the fabric roll being used (see FIG. 5). Since the outside diameter of the core of roll 90 is usually approximately 5 inches, a typical spacing for rollers 205 and 207 is approximately 4 inches (ie. the distance between the two rollers as mounted on sub-frame member 213 is approximately 4 inches). In particular, this specific spacing of rollers 205 and 207 prevents fabric roll 90 from falling between the rollers as roll 90 becomes smaller as fabric is dispensed (ie. as sheet 91).

It is contemplated, of course, that any number of rollers can be used (spaced at any variety of distances) in practicing the subject invention, the primary purpose being merely to rotatably support fabric roll 90 as fabric is being dispensed.

In still further alternative embodiments of the subject invention, rollers 205 and 207 may be replaced by an elongated and generally arcuate metal sheet which is welded or mechanically fastened (or otherwise fixedly attached) to frame member 203. The shape of such an arcuate sheet should be such that it can accommodate a variety of roll sizes yet will continue to carry a roll of fabric 90 and allow it to rotate therein as the roll size decreases during dispensing.

In order for dispenser 200 to travel easily along a surface of a roof structure, two rollers 221 and 223 are provided mounted at the front and the rear of the structure of the dispenser (see, for example, FIGS. 3 and 6). In the illustrated embodiment, these rollers are of conventional type such as rollers typically used on boat trailers. In the alternative, these rollers may be of any design, material, or construction so long as they permit dispenser 200 to be readily advanced along a roof surface. In this respect, roller 223 may be mounted by conventional means proximal the front of frame 203 with roller 221 mounted by similar means towards the rear of dispenser 200 and proximal sub-frame 213. Specifically, the use of rollers 221 and 223 solves one of the problems of the prior art discussed herein. In particular, because these rollers support dispenser 200 by rolling on top of a purlin (i.e. on the upper surface of a purlin top flange), no cross support member 70 is in the path of the rollers, and hence, the dispenser can travel the entire length of a roof structure without having to be removed. Still further, because rollers 221 and 223 do not interact with or rely on any particular orientation of purlin flange 8, dispenser 200 may dispense in any direction along any given purlin.

In the process of fabric dispensing, it is desirable that a dispenser, such as dispenser 200, be capable of maintaining itself in a desired (e.g. forward) position on a roof surface and not have a tendency to reverse in direction i.e. opposite that of dispensing. For example, winds or other forces may catch the fabric sheet 91 (being dispensed from fabric roll 90) and tend to pull the fabric dispenser from its desired location or position on a roof surface (i.e. in the direction reverse of dispensing). Therefore, optionally provided in the present invention is an anti-reverse brake structure 220 which prevents dispenser 200 from being drawn backwards in a direction opposite that of the intended direction of dispensing. Such a brake structure also serves as an integral part of the fall protection system which is described in detail below.

Figure 4:
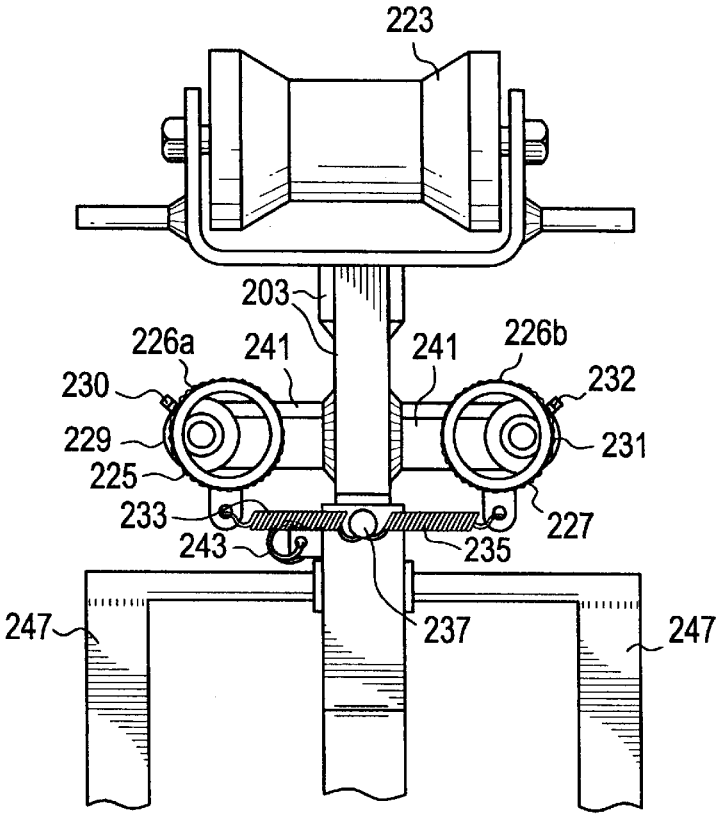
FIG. 4 is a partial, underside view of a rolled fabric dispenser according to one embodiment of this invention.

Referring in particular now to FIG. 4, one embodiment of anti-reverse brake structure 220 is illustrated and is generally comprised of two metal cylinders 225 and 227 which, as shown, are eccentrically mounted (i.e. mounted off-center) in a pivotable manner to shafts 229 and 231 respectively. Preferably, these cylinders have a granular outer surface (i.e. surfaces 226*a* and 226*b*) for better gripping and thus better anti-reverse holding power. In order to retain cylinders 225 and 227 at a relatively fixed location (about shafts 229 and 231) when the dispenser is at rest, two springs 233 and 235 are provided which are attached to each cylinder respectively and to a common location 237 at cross bar 241. Normally, if cylinders 225 and 227 are caused to rotate about shafts 229 and 231, springs 233 and 235 will tend to pull or return these cylinders back to their original position. Granular outer surfaces 226*a* and 226*b* may, of course, be substituted for by any material capable of gripping a suitable surface of a purlin.

Also, albeit optionally, located proximal the outside walls of cylinders 225 and 227 are cylinder engagement rods 230 and 232 which serve to restrict the rotational movement of cylinders 225 and 227 about shafts 229 and 231. In particular, cylinder engagement rods 230 and 232 are simply provided so that cylinders 225 and 227 are always oriented with a slight rearward angle of rotation against the force of springs 233 and 235 prior to dispenser 200 being mounted upon a purlin 6.

Figure 4A:
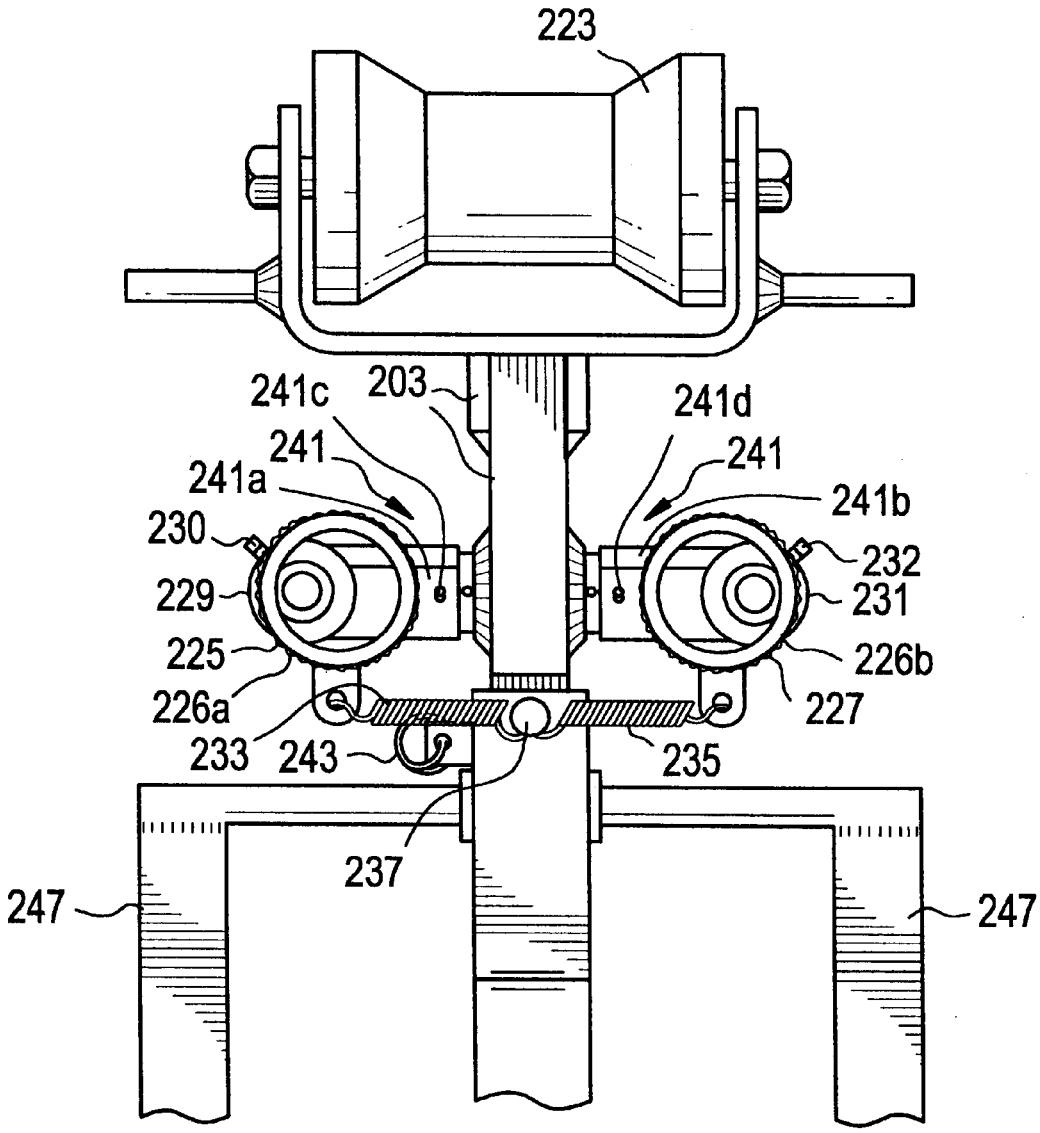
FIG. 4A is an alternative embodiment of the rolled fabric dispenser illustrated in FIG. 4.

In still a further alternative embodiment of anti-reverse brake structure 220 (illustrated in FIG. 4A), cross bar 241 is constructed so that its arms may be extended or shortened thereby to increase or decrease the distance between the innermost walls of cylinders 225 and 227. Cross bar 241 is constructed so as to be adjustable, in this regard, because purlins may be encountered which are not of uniform width. Similarly, it may be desirable to operate dispenser 200 on building elements which are not purlins e.g. such as bar joists. In such situations, arms 241*a* and 241*b* may be simply adjusted by sliding the arms further on or off of the base portion of cross bar 241 thereby to increase or decrease the size of the purlin passageway. After adjusting the arms to the appropriate/desired lengths, arms 241*a* and 241*b* may be effectively locked in position by the use of locking pins 241*c* and 241*d* inserted through apertures (shown illustrated but not numbered) in each as well as in the base portion of cross bar 241.

When operating an embodiment of dispenser 200 which includes anti-reverse brake structure 220, a purlin 6 or other roof structural member is disposed between cylinders 225 and 227. If dispenser 200 is advanced in the typical forward direction (i.e. in the direction of roller 223), then, as the preferably granular outer walls of cylinders 225 and 227 engage the surface of the purlin 6, the cylinders will be caused to pivot about their respective shafts 229 and 231 thus releasing the purlin 6 and allowing passage of the purlin 6 therebetween (i.e. by effectively increasing the distance from one cylinder wall to the next because of the rotation of the cylinders in combination with the eccentric mounting arrangement). In effect, as dispenser 200 is moved forward, the cylinder walls rotate away from one another (about shafts 229 and 231), thus increasing the width of the purlin passageway and allowing the forward advancement of dispenser 200.

If, however, an attempt is made or a force is imparted which seeks to move dispenser 200 in a direction reverse of dispensing, cylinders 225 and 227 will again be caused to rotate about their eccentric pivot points (i.e. shafts 229 and 231), but this time in the opposite direction. Because of their eccentric attachment to shafts 229 and 231, the cylinders will then engage the side surfaces of the purlin (or other building element) with sufficient force to prevent reverse travel of the dispenser. This is because as the cylinders pivot when an attempt is made to move dispenser 200 in a reverse direction, the distance between the two cylinders 225 and 227 decreases (as their walls rotate towards each other) thus effectively closing off the otherwise open passageway. If a continued attempt to move dispenser 200 in a reverse direction is made, the abrasive (granular) walls of cylinders 225 and 227 will simply bite harder into the side surfaces of the purlin 6. Thus, with the aforedescribed brake structure of the illustrated embodiment, the dispenser is effectively prohibited from being advanced in the wrong direction on the purlins.

It is through the use of this brake structure 220 in combination with the biasable brake plate 217 (and, in some embodiments, optional brake plate 218) described hereinabove that dispenser 200 is able to complete a safety-net type fall protection system which is able to conform to OSHA standards (see FIG. 9) without adding the additional weight and expense of typical of prior art systems.

Specifically, dispenser 200 is able to sufficiently secure a layer of fabric 91 such that the layer is capable of conforming with the OSHA standard of safety net fall protection as enumerated in 29 C.F.R. Section 1926.502c. In particular, in order to conform to this standard, a safety net type fall protection system must be able to withstand the force of a 400 lb weight dropped from a height of at least 42 inches. Further, the weight which is dropped must not have a diameter of greater than 30+/−2 inches. Such tests have been performed on a layer of fabric sheet 91 secured with dispenser 200 with such layer being able to withstand and support the dropped 400 lb weight "W" from a height of at least 42 inches as illustrated as distance "X" in FIG. 9. It should be noted, of course, that the particular strength of roof fabric which is employed is critical in such a test and that such factors must be taken into account when utilizing the above described system as fall protection. In this regard, the fabric used in the aforementioned tests is a conventional high-density woven polyethylene fabric.

Such a system as disclosed by the present application is able to conform to such a test because of the particular effectiveness of anti-reverse brake structure 220 in securing dispenser 200 at a given location on a purlin 6 (and preventing it from being pulled in a reverse or backwards direction when an object is dropped on the fabric) and further because brake plate 217 (or brake plates 217 and 218 in combination) is particularly effective at preventing the unwanted rotation of fabric roll 90. It is noted here, of course, that although the leading end of the fabric is secured by dispenser 200, the trailing end is secured by the conventional installation and securing of the metal sheeting layer "ML" shown in FIG. 9.

Figure 7:
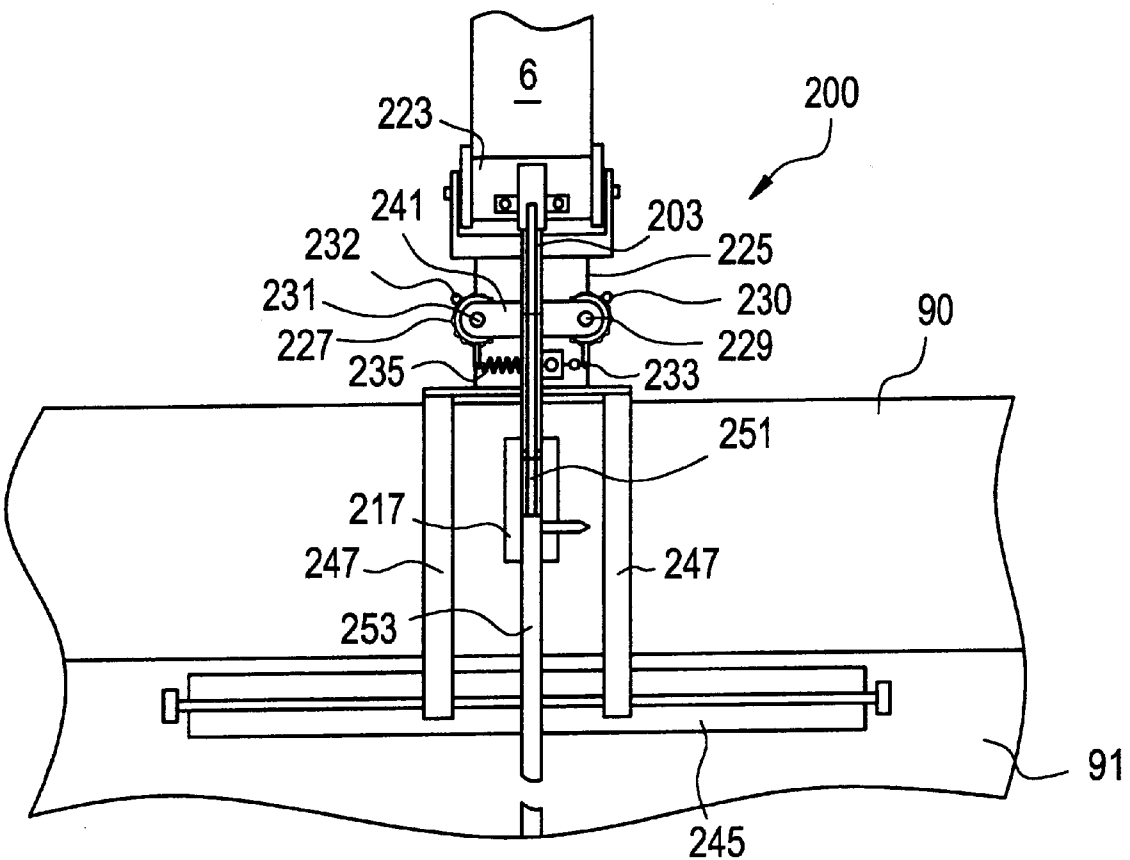
FIG. 7 is a top view of the embodiment of FIG. 6 shown in combination with a fabric roll on a roof structure.

Turning now to one example of a manner of operating the subject invention (both as a dispenser and as a manner of constructing a fall protection system), dispenser 200 may be simply lifted into operating position by placing dispenser 200 so that rollers 223 and 221 are resting on the upper surface of a purlin 6 (or other analogous building element) as shown in FIG. 7. In this position, cylinders 225 and 227 are located a distance slightly below the horizontal plane of these rollers so that cylinders 225 and 227 will embrace (with the force of springs 233 and 235) the respective sides of the purlin.

Figure 8:
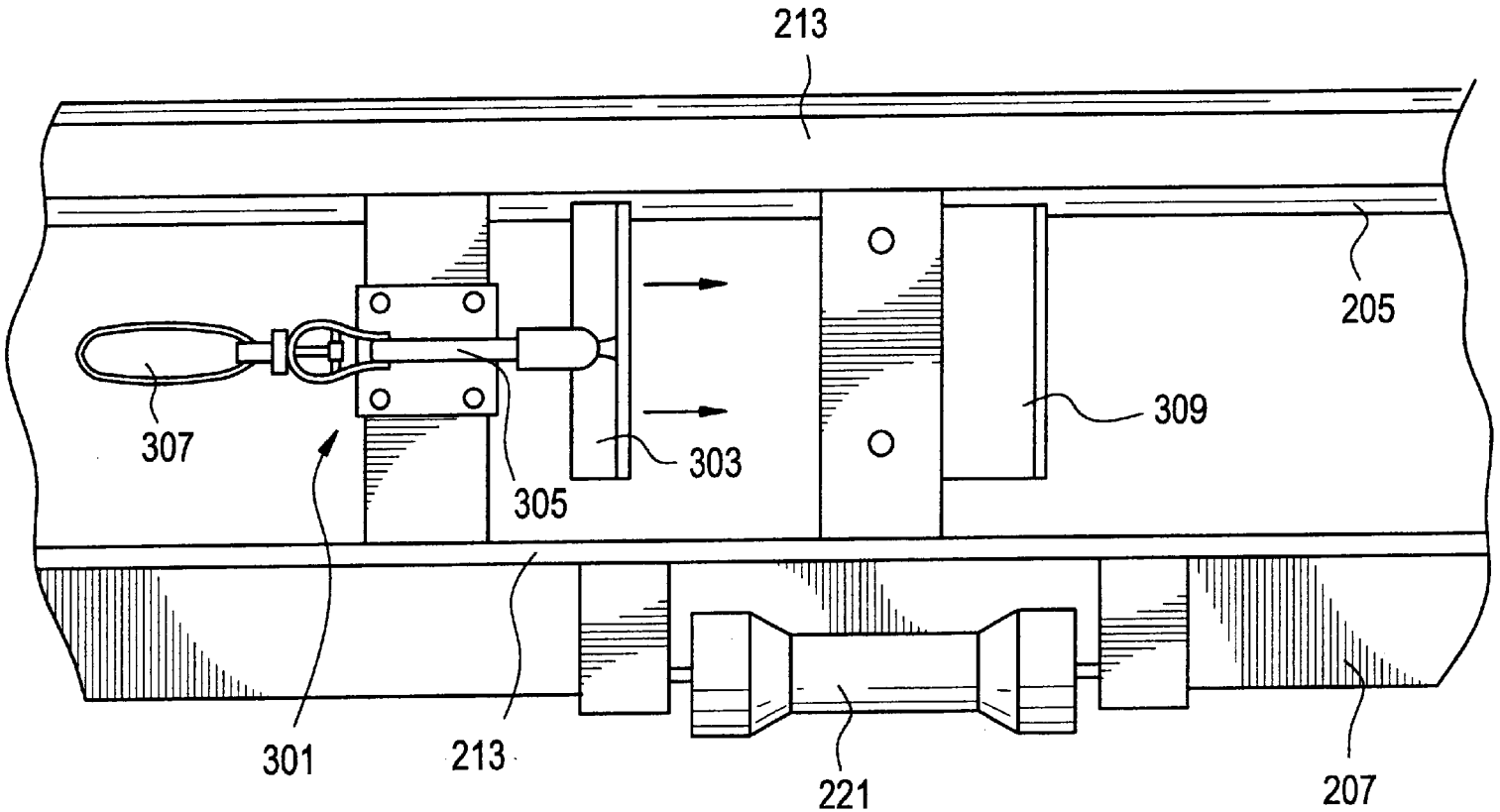
FIG. 8 is a partial underside view of an embodiment of an optional stabilizing clamp according to the subject invention.

In certain embodiments of the subject invention as illustrated in FIG. 8, stabilizing clamp 301 is optionally included to provide further stability to dispenser 200 before a roll 90 is loaded onto the rollers. In the subject embodiment, stabilizing clamp 301 is pivotally mounted to the underside of sub-frame 213 and includes an adjustable stabilizing rod 305 at the end of which a stabilizing plate 303 is fixedly attached. Also attached to sub-frame 213, parallel to but opposite in orientation to that of adjustable stabilizing plate 303, is stationary stabilizing plate 309. Between plates 303 and 309 then, is a space for the passage of a building element i.e. such as a purlin 6 therebetween. In order to operate stabilizing clamp 301, lever 307 is utilized to shift stabilizing plate 303 into engagement with one side or surface of a purlin 6 while stationary stabilizing plate 309 engages the other side of the purlin. In this manner, dispenser 200 is effectively clamped to the purlin and thus rendered more stable when resting upon the purlins before a fabric roll 90 is loaded thereon.

Once dispenser 200 is in place on the roof structure (and in some embodiments stabilizing clamp 301 is engaged) a roll of fabric 90 may be loaded onto the dispenser. This may be accomplished by merely lifting brake plate 217 (and arm 215) against the force of tension spring 243. In one embodiment of the subject invention, brake plate 217 may be locked in place in the open position utilizing a locking bar 251 (see FIGS. 6 and 6A). Locking bar 251 is simply a metal rod with angularly extending portions at each end which is rotatably attached substantially parallel to arm 215 via conventional brackets. Once brake plate 217 (and arm 215) is lifted a sufficient distance against the force of spring 243, the brake plate may be locked in place in the open position by simply rotating locking bar end 251' into engagement with locking plate 249. Once end 251' is in engagement with locking plate 249, brake plate 217 (and in some embodiments plate 218) and arm 215 are locked in the open/roll loading position against the force of spring 243. At this time a fabric roll 90 may simply be placed upon rollers 205 and 207 and brake plate 217 and arm 215 released (via the release of end 251' of locking bar 251). Once this is done, brake plate 217 should be in engagement with fabric roll 90. At this time it is also appropriate to release stabilizing clamp 301 (i.e. by operating the toggle lever 307 to the open position) in preparation for dispensing.

Figure 9:
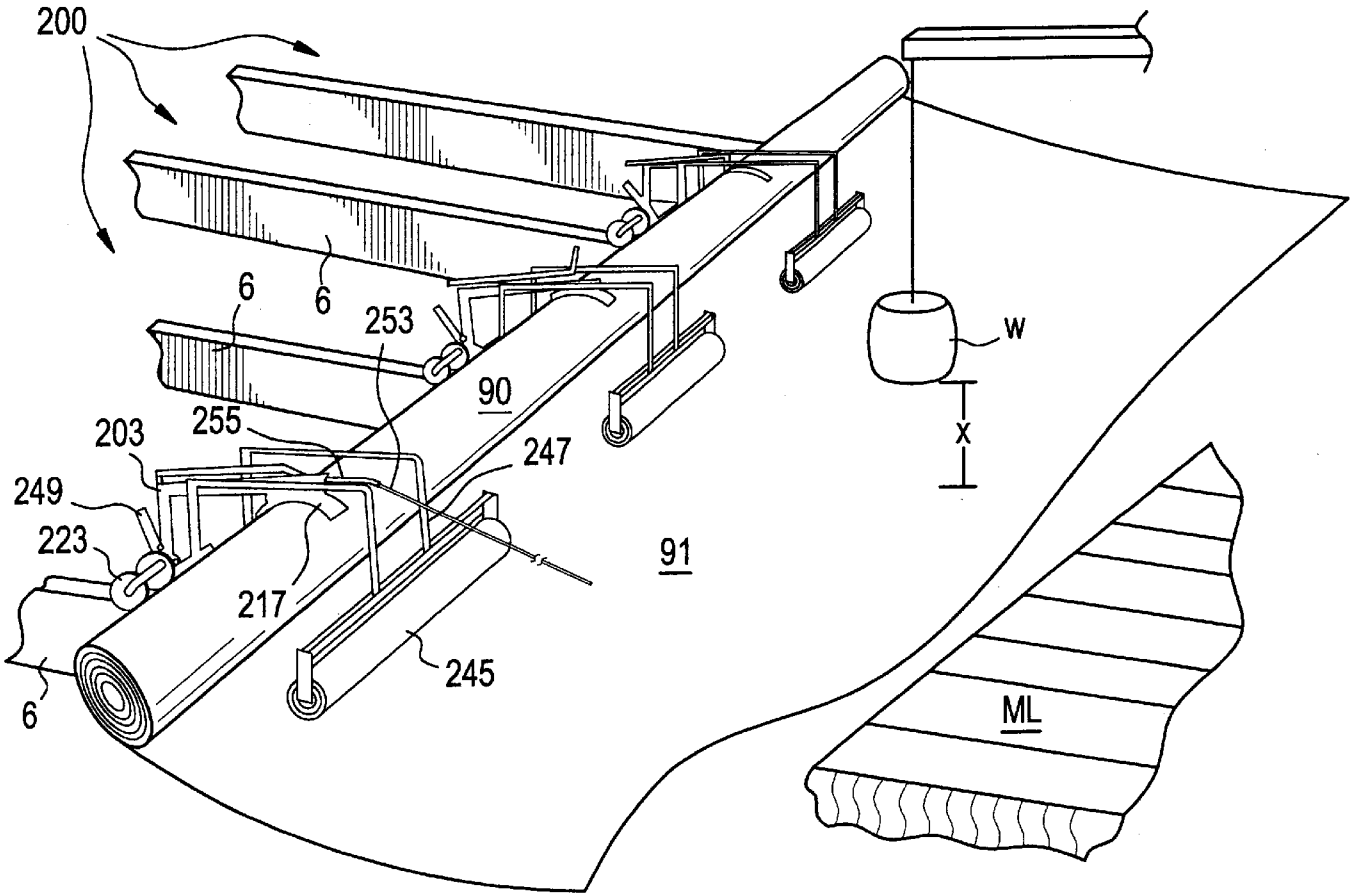
FIG. 9 is a partial three-dimensional view of an embodiment of the fall protection system according to the subject invention.
Figure 10:
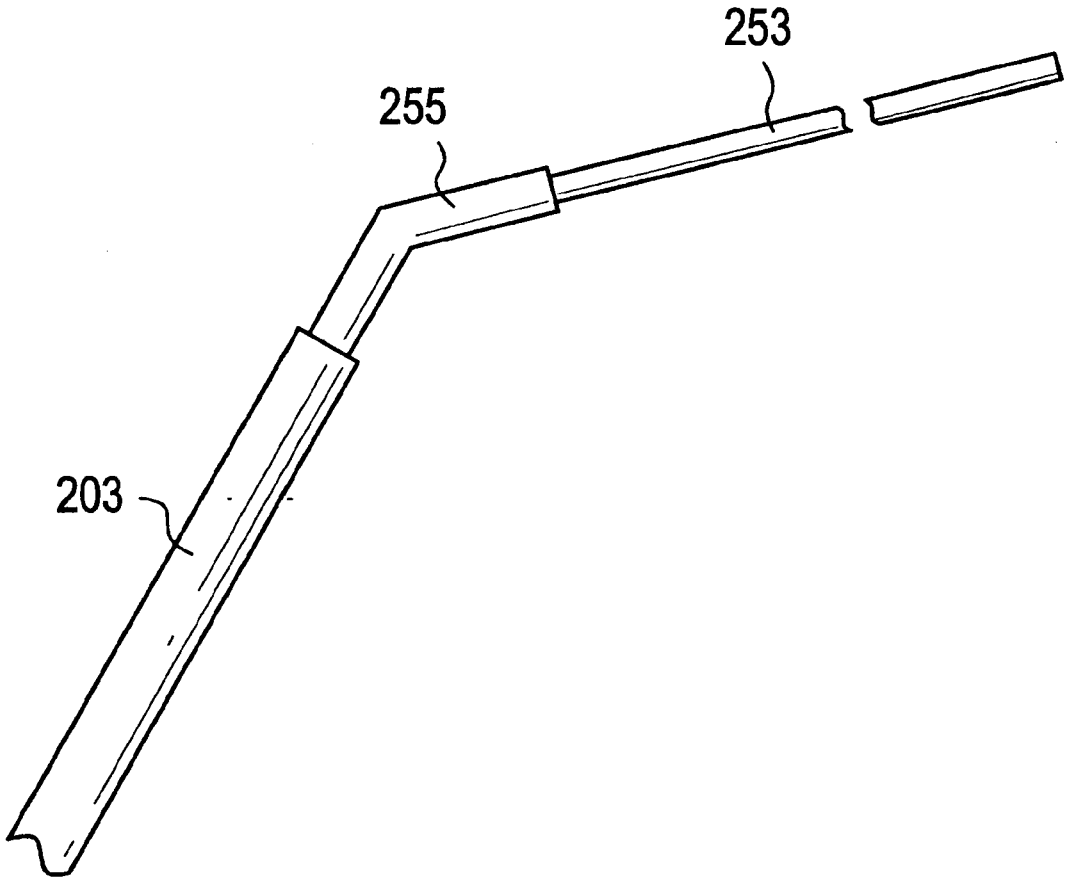
FIG. 10 is a side plan view of an optional extension device constituting a part of an embodiment of this invention.

Thereafter, in order to begin the roof fabric dispensing process at one end/side of the building structure, the loose or trailing end of fabric roll 90 is initially unrolled and secured (e.g. by adhesive tape) to the end purlin (or rake angle) located at the end/side of the building from which the dispensing is to commence. In order that an initial portion of fabric 90 be more easily unrolled, brake plate 217 may be manually lifted to release braking pressure on the fabric roll. The entire apparatus may then be pushed forward, utilizing push pole 253 as shown in FIG. 9, to dispense fabric as sheet 91. As dispenser 200 is pushed forward, it simply rolls along the top surface of purlin 6 on rollers 221 and 223. In order to insure that push pole 253 may be easily reached (i.e. is at a reachable height) angular adapter 255 is provided which simply inserts into an opening of frame member 203 (see FIGS. 9 and 10). Push pole 253 may then be inserted into the opposite end of adapter 255 thus angling push pole 253 to a much lower height.

In a preferred embodiment of the subject invention illustrated in FIGS. 5, 6, and 6A, there may be (optionally) provided an arm structure 247 and associated padded cylindrical roller 245 so located and attached to frame member 203 such that it is capable of biasing fabric sheet 91 against a surface of the roof structure as the sheet is dispensed (to insure that fabric is laid out in a substantially flat manner). In particular, arm 247 is pivotally attached to frame 203 (so it may be lifted out of the way in order to load a fabric roll 90 and will adjust as roll 90 becomes smaller) and is of sufficient weight in combination with padded roller 245 to passively bias fabric sheet 91 (via gravity) against a surface of the roof structure without need for external forces. However, it is contemplated that in some alternative embodiments, it may be desirable to employ a spring or other device to provide an active biasing force.

In still another embodiment (FIG. 5), locking plate 248 is provided which may be positioned in place, such as by the tightening of wing nut 250, for example, against flange 247' located on arm 247, during the dispensing of fabric when arm 247 is in contact with fabric sheet 91 (i.e. in the "biasing" position). When locking plate 248 is oriented as illustrated (against flange 247'), locking plate 248 holds arm 247 securely against the surface of the fabric sheet 91 even during strong winds or other disruptive forces.

Figure 5A:
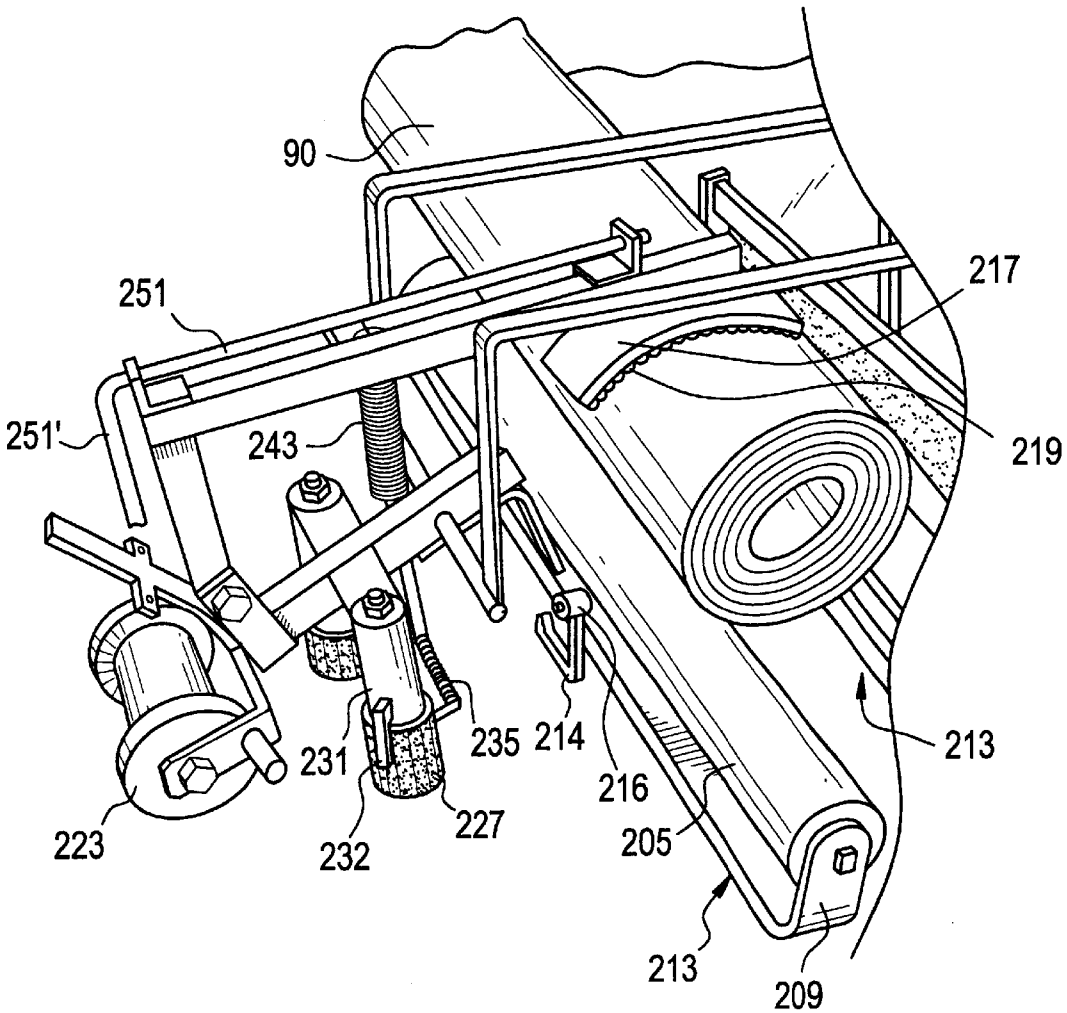
FIG. 5A is an alternative embodiment of the rolled fabric dispenser illustrated in FIG. 5.

In yet even a further embodiment (illustrated in FIG. 5A), a retaining hook 214 is provided which is, in one embodiment, pivotally attached (via pivot 216) to or proximal to sub-frame 213. Retaining hook 214 is provided so that it may be positioned under a surface of purlin top flange 8. Thus, if a disruptive force is applied to dispenser 200 (such as by an object dropped on sheet 91 as the sheet is being dispensed), the retaining structure will aid in securing dispenser 200 on the purlin (by its contact with the undersurface of purlin flange 8).

During operation (ie. during rolled fabric dispensing) then, rather than biasing fabric roll 90 against a surface of purlins 6 (as in prior art devices), dispenser 200 includes a unique structure by which fabric roll 90 is supported/carried above (ie. not in contact with) purlins 6. In utilizing this unique carrying structure, which is not limited in the length of a roll which it can carry, dispenser 200 is pushed (e.g. via push pole 253) along the length of a building structure, and fabric is pulled (ie. dispensed) from fabric roll 90 to form fabric sheet or layer 91. In this manner, fabric layer 91 is installed across the entire length of the building to complete a vapor retarding barrier in the insulated roof structure.

As hereinabove described, some exemplar dispensers of the subject invention are capable of securing fabric sheet 91 sufficiently well that the layer formed by sheet 91 (as it is dispensed by certain embodiments of dispenser 200) is capable of conforming to the OSHA standard for safety-net type fall protection enumerated at 29 C.F.R. Section 1926.502c. In particular, once the first or starting end of the fabric is secured at the beginning of the roof structure (e.g. at the rake angle), such as by metal screws or adhesive tape or glue, for example, the first section of roof is installed, as aforedescribed, by unrolling at least a first layer of insulation and thereafter placing the metal sheeting layer on top of the layer of insulation. Once the metal sheeting layer ML is in place (see FIG. 9), this layer is fixed by screws or other conventional means. It is at the completion of this first layer that the trailing end of the fabric sheet 91 first becomes sufficiently secured to comply with specific OSHA requirements. Thereafter, each additionally installed section of roof will continues to secure fabric sheet 91 as the installation progresses across the top of the building structure.

Still further, it is contemplated that in utilizing certain embodiments of the present invention, fabric sheet 91 may be anchored such that the sheet is capable of supporting the weight of installed insulation batts without need for other mechanical supports (e.g. banding, straps, or cantilevers) such as are used in certain known prior art roofing systems. Even further, during fabric installation with the present invention, in certain embodiments there will be no need to secure fabric sheet 91 to the surface of the purlins with adhesive or other means (except at the starting end). In this respect, fabric sheet 91 may be anchored sufficiently in place (tight or with drape) utilizing the braking capabilities of unique dispenser 200 to support the weight of subsequently installed insulation (the system as a whole thereafter being secured in place when the metal roof or other type sheeting is secured to the purlins with sheet screws or other conventional means). In like fashion, the dispensers of the subject invention are capable of securing fabric sheet 91 against wind and/or other disruptive weather types.

Although the particular order of installing the elements of roof sections as described herein is generally conventional in nature, it is the use of unique dispenser 200 which enables the practice of the subject invention as a fall protection system which, in this respect, conforms to OSHA standard 29 C.F.R. Section 1926.502c when properly used. This OSHA standard is incorporated herein by reference.

In particular, as aforesaid, brake plate 217 (or multiple brake plates 217 and 218) in combination with anti-reverse brake structure 220 secure the leading end of the fabric sheet 91 i.e by securing roll 90 at a fixed location and against rotation. This provides a relatively taut layer of fabric 91 which is able to withstand and support (as required by the aforesaid OSHA standard), a 400 lb weight "W" dropped from a height of at least 42 inches (the height indicated as distance "X" in FIG. 9). Such a layer does not, of course, protect an installer from falling from the side of a roof structure, nor does it protect an installer from falling through any area not covered by the layer of fabric i.e. such as the area ahead or in front of the dispenser 200 as fabric is being unrolled over the roof structure. Therefore, it is required that at all times supplemental fall protection, such as harnesses and/or railings always should be used to protect workers in those areas. In this respect, however, this invention constitutes a significant step forward in the safety art by replacing the heretofore cumbersome cantilever equipment etc. with a sheet of plastic which is a part of the roof system itself.

In certain further embodiments of this invention, when multiple. dispensers are being employed such as illustrated in FIG. 9, multiple chains 259 (as seen in FIG. 5) may be attached at aperture 257 to link each dispenser 200. When linked, if a dispenser falls from a purlin, this safety feature may, at times, prevent the dislodged dispenser from falling to the ground (because the dispenser is attached to the other dispensers which are anchored in place and because the chain will catch on the purlins which extend between the multiple dispensers 200).

Finally, in dispensing fabric, the dispensers of this invention may be employed to form the sheets in a variety of configurations such as stretched tightly (laterally) across purlins 6 or in a draped fashion between the purlins such as is taught in my co-pending U.S. patent application Ser. No. 09/511,306, filed Feb. 23, 2000 and entitled ROLLED FABRIC DISPENSING METHOD, now U.S. Pat. No. 6,393,797, the disclosure of which is incorporated herein by reference.

Once given the above disclosure, many other features, modifications, and improvements will become apparent to the skilled artisan. Such other features, modifications, and improvements are therefore considered to be part of this invention, the scope of which is to be determined by the following claims.

I claim:

1. A rolled fabric dispensing device for applying a sheet of fabric from a roll of fabric across a surface of a building structure, the rolled fabric dispensing device comprising a frame member and an anti-reverse brake, said anti-reverse brake including:

a first and a second shaft located proximal said frame member;

a first and a second cylinder each spaced from the other and each eccentrically mounted to said first and said second shaft in a manner to permit pivotal movement of said cylinders about an axis of said shafts;

a first spring attached proximal said frame member and to said first cylinder;

a second spring attached proximal said frame member and to said second cylinder;

wherein a distance between said first and said second cylinder defines a space for passage of a building element therebetween.

2. The rolled fabric dispensing device according to claim 1, wherein said anti-reverse brake further includes a cylinder engagement rod so located proximal a surface of a said cylinder so as to orient said cylinder at an angle of rotation against the force of said spring attached to said cylinder.

3. The rolled fabric dispensing device according to claim 1, which further includes means for rotatably supporting said roll of fabric and means for selectively preventing rotation of said roll of fabric when supported on said supporting means.

4. The rolled fabric dispensing device according to claim 3, wherein said means for selectively preventing rotation of said roll of fabric comprises:

a first arm member having a first and a second end, said first end pivotally attached to said frame member;

a first plate member attached proximal said second end of said first arm member in a manner which allows it to be selectively brought into and out of engagement with said roll of fabric; and a spring attached between said first arm member and said frame member so located as to provide a biasing force to said plate member in the direction of said roll of fabric.

5. The rolled fabric dispensing device according to claim 4, wherein said means for selectively preventing rotation of said roll of fabric further includes:

a second arm member having first and second ends attached to said second end of said first arm member; and a second plate member for contacting a surface of a fabric roll;

wherein said first plate member is attached to said first end of said second arm member and said second plate member is attached to said second end of said second arm member.

6. The rolled fabric dispensing device according to claim 5, wherein said first and said second plate members each including an arcuate surface comprising a friction plate so located as to contact said roll of fabric when said plate member is selectively brought into contact with said roll of fabric.

7. The rolled fabric dispensing device according to claim 1, further including a fabric sheet biasing mechanism comprising:

an arm structure pivotally attached to said frame member; and a biasing member attached proximal an end of said arm structure and capable of biasing a fabric sheet against a surface of a building structure as the fabric sheet is dispensed from a roll of fabric.

8. The rolled fabric dispensing device according to claim 7, further including a locking mechanism for locking said fabric sheet biasing mechanism in a biasing position comprising:

a locking bar;

a flange plate positioned to selectively engage said locking bar; and wherein said locking bar is so constructed as to be rotatable into engagement with said flange plate to secure said biasing member against a surface of a fabric sheet.

9. The rolled fabric dispensing device according to claim 8, further including a retaining hook pivotally attached to a frame member of said dispenser and so located as to be positionable under the surface of a roof structural member for securing said dispenser to roof member.

10. The rolled fabric dispensing device according to claim 1, which further includes a first cylindrical roller and a second cylindrical roller so spaced and located as to form a support for said roll of fabric.

11. The rolled fabric dispensing device according to claim 10, wherein said first and second cylindrical rollers are so located within said dispenser such that said second roller is located at a higher elevation with respect to said first roller and wherein said second roller is the rearward most roller with respect to the direction of dispensing of said fabric.

12. The rolled fabric dispensing device according to claim 1, which further includes a first and a second roller for contact with a surface of a building structure.

13. A rolled fabric dispensing device for applying a sheet of fabric from a roll of fabric across a space in a building structure between at least one pair of spaced longitudinally extending substantially parallel structural members, said rolled fabric dispensing device being capable of securing a first end of said sheet of fabric such that when a second, opposite end of said sheet of fabric is secured, said sheet is capable of supporting a 400 lb. weight dropped from a height of 42 inches, the rolled fabric dispensing device comprising the device of claim 1, 2, 3, 4, 5, 6, 9, or 11.

14. A method of fabricating an insulated roof structure of a building which includes at least one pair of longitudinally spaced and substantially parallel structural members, the method comprising:

securing a first end of said roof fabric;

locating a second end of said roof fabric within the roof fabric dispensing device of claim 1;

moving said dispensing device along said pair of spaced longitudinally extending, substantially parallel structural members to dispense a sheet of said roof fabric across the space between said pair of structural members such that said sheet of said fabric so dispensed and extending across said space provides fall protection across said space during said dispensing of said sheet of roof fabric across said space.

15. The method of claim 14, wherein said sheet of roof fabric located across said space during said dispensing thereof is capable of supporting a 400 lb. weight dropped from a height of 42 inches.

16. The method of claim 15, wherein said roof fabric is dispensed from a fabric roll and wherein said fabric roll is of a length which spans at least three spaced purlins.

17. The method of claim 15, wherein said roof fabric is comprised of polyethylene.

18. The method of claim 17, wherein said roof fabric consists essentially of a high-density, woven polyethylene fabric.

19. A rolled fabric dispensing device for applying a sheet of fabric from a roll of fabric across a surface of a building structure comprised of at least one pair of spaced, longitudinally extending substantially parallel structural members, the rolled fabric dispensing device comprising:

a frame member;

means for rotatably supporting a fabric roll; and a mechanism for creating a biasing force against a surface of said fabric roll which includes:

a first arm member having a first and a second end, said first end being pivotally attached to said frame member;

a second arm member having first and second ends, said second arm member being attached to said second end of said first arm member;

a first brake plate and a second brake plate spaced from said first brake plate, said first and second brake plates each being connected to said second arm member; and a spring so located and connected between said first arm member and said frame member so as to bias said brake plate against a surface of a fabric roll.

20. The rolled fabric dispensing device according to claim 19, wherein said first and said second brake plates comprise a generally arcuate surface and a friction plate attached to said arcuate surface for contact with said fabric roll.

* * * * *